US006695181B1

(12) United States Patent
Kreitzer et al.

(10) Patent No.: US 6,695,181 B1
(45) **Date of Patent: *Feb. 24, 2004**

(54) MUD GUN AND HOPPER ASSEMBLY

(76) Inventors: David F. Kreitzer, 9049 N. Arroya Grande Dr., Phoenix, AZ (US) 85028; Dan B. Pool, 12772 E. Turquoise, Phoenix, AZ (US) 85029; Toby Edwards, 2327 E. Aire Libre, Phoenix, AZ (US) 85022

( * ) Notice: Subject to any disclaimer, the term of this patent is extended or adjusted under 35 U.S.C. 154(b) by 0 days.

This patent is subject to a terminal disclaimer.

(21) Appl. No.: 09/928,107

(22) Filed: Aug. 10, 2001

Related U.S. Application Data

(60) Provisional application No. 60/224,819, filed on Aug. 11, 2000.

(51) Int. Cl.[7] ..... A01G 35/00
(52) U.S. Cl. ..... 222/608; 222/609
(58) Field of Search ..... 266/271, 272, 266/273; 222/608, 609; 401/48

(56) References Cited

U.S. PATENT DOCUMENTS 1,288,496 A * 12/1918 Brosius ..... 266/273
2,820,672 A * 1/1958 Arce et al. ..... 222/608
5,255,846 A * 10/1993 Ortega ..... 239/103
5,878,925 A * 3/1999 Denkins et al. ..... 222/608
6,146,039 A * 11/2000 Pool et al. ..... 401/48

* cited by examiner

*Primary Examiner*—Scott Kastler
(74) *Attorney, Agent, or Firm*—Parsons & Goltry; Robert A. Parsons; Michael W. Goltry

(57) ABSTRACT

A generally wedge-shaped mud box with a bottom wall has a mud outlet orifice through which mud will flow. An edge of the wedge-shaped box has a rectangularly shaped cover rotatably attached so as to be rotatable between an filling position and an operating position. A releasable biasing structure biases the cover toward a bottom wall of the box so as to force mud contained in the box toward the outlet orifice. A mud gun, including a hollow body with an inlet and an outlet orifice, is releasable attached to the outlet orifice of the box. When air under pressure is introduced into an air inlet of the gun, mud entering through the inlet orifice is forced out through the outlet orifice of the gun. A nozzle chassis is affixed to the gun with a plurality of different nozzles movably attached thereto, and each nozzle is movable between a stored and an aligned position so that only one nozzle of the plurality of nozzles is aligned with the outlet orifice of the gun at a time.

25 Claims, 6 Drawing Sheets

10
14
15
28

10
20
21
21
17
16
15
14
29
31
32
28
33
30
41
36
40
38
37
35

MUD GUN AND HOPPER ASSEMBLY

CROSS-REFERENCE TO RELATED APPLICATION

This application claims the benefit of Provisional Application Ser. No. 60/224,819 filed Aug. 11, 2000.

FIELD OF THE INVENTION

This invention relates to mud application assemblies.

More particularly, the present invention relates to mud application assemblies including mud guns and associated mud hoppers.

BACKGROUND OF THE INVENTION

Mud guns, which are used to apply "mud" or joint compound to walls, ceilings, etc. are well known in the art. In this disclosure, it will be understood by those skilled in the art that the term "mud" as used in conjunction with the various apparatus includes any material that can be dispensed by the disclosed structures. Also, hoppers for temporarily storing the mud and allowing the mud to flow into the gun as the mud is applied are well known. However, several problems are prevalent in these prior art devices that can cause problems during usage.

The mud guns generally extrude the mud through a nozzle at the front of the gun. Different sized and shaped nozzles are used in different work related applications. Each time the nozzle is changed the gun must be emptied so that mud does not flow out as one nozzle is removed and another nozzle is attached. Even with the emptying of the mud gun the task of changing the nozzle can be a relatively messy task. Further, the spare nozzles must be stored in a relatively accessible place.

Another problem that is prevalent in the mud gun and hopper apparatus is that mud generally must flow under the force of gravity from the hopper into the gun. In many applications and gun orientations the mud does not flow evenly and continuously. Further, the hopper must be substantially full to achieve an even and continuous flow. As the mud in the hopper becomes depleted, there is a tendency for it to hang-up in the corners so that much time and effort is required to get all of the mud to flow out of the hopper or the operator must refill the hopper more often without actually using all of the mud in the hopper.

It would be highly advantageous, therefore, to remedy the foregoing and other deficiencies inherent in the prior 13 art.

Accordingly, it is an object of the present invention to provide a new and improved mud gun for use in applying joint compound to drywall joints and the like.

Another object of the invention is to provide a new and improved mud gun that is easier to use.

And another object of the invention is to provide a new and improved mud hopper for use with a mud gun.

Still another object of the invention is to provide a new and improved mud hopper for use with mud guns which is easier to use and more efficient.

SUMMARY OF THE INVENTION

Briefly, to achieve the desired objects of the present invention in accordance with a preferred embodiment, provided is a mud application assembly including a mud hopper having an outlet orifice attachable to a mud gun and through which mud will flow into an attached mud gun, a cover attached to the mud hopper and rotatable between an open position for filling the hopper with mud and a closed position substantially covering a mud-receiving opening of the hopper during operation, and a releasable biasing structure coupled to the hopper for applying a bias to force mud contained in the hopper toward the outlet orifice.

To further achieve the desired objects of the present invention in accordance with a preferred embodiment, provided is a mud application assembly including a mud gun having a hollow body with a mud inlet orifice and a mud outlet orifice. The body further includes an air inlet constructed to have a source of pressurized air attached so that when air under pressure is introduced into the air inlet of the mud gun, mud entering through the inlet orifice is forced out through the outlet orifice. A nozzle chassis is affixed to the mud gun with a plurality of nozzles movably attached thereto. Each nozzle of the plurality of nozzles is movable between a stored position and a position aligned with the outlet orifice of the mud gun so that only one nozzle of the plurality of nozzles is aligned with the outlet orifice at a time.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
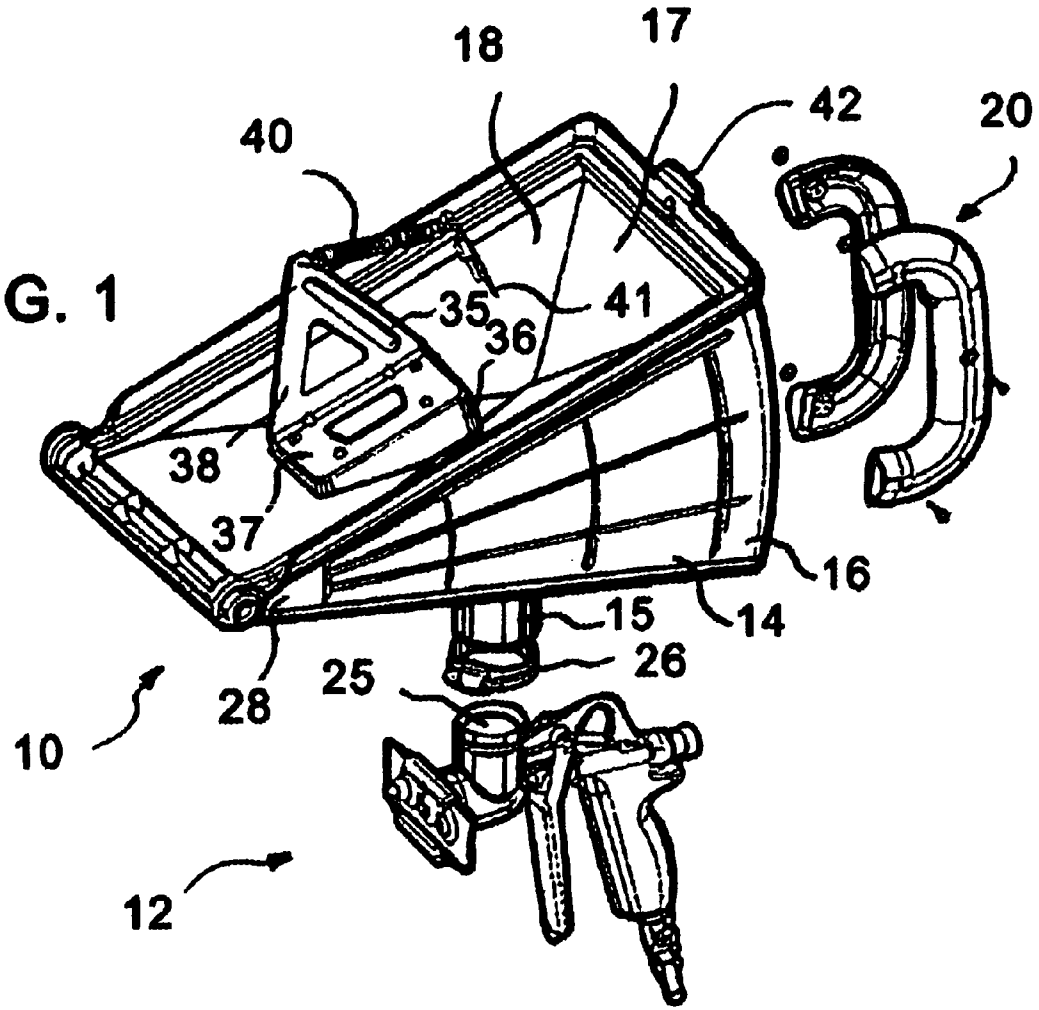
FIG. 1 is a partially exploded isometric view of a mud gun and hopper in accordance with the present invention.

Turning now to the drawings in which like reference characters indicate corresponding elements throughout the several views, attention is first directed to FIG. 1, which illustrates a mud hopper 10 and mud gun 12 in accordance with the present invention. Mud hopper 10, which refers to the entire assembly, includes a wedge shaped box 14 with a bottom surface or wall having an outlet orifice 15 through which joint compound or the like flows into mud gun 12. The joint compound is then ejected or extruded by mud gun 12, as mud gun 12 is moved along a joint or wallboard surface. Hopper 10 further includes a left side 16, a rear side or end 17, and a right side 18. A handle 20 (illustrated disassembled in FIG. 1) is conveniently attached to rear side 17 to provide additional handling and balancing capabilities. As can be best seen in FIG. 4, handle 20 is formed in two parts which can be conveniently assembled over spaced apart buttons 21 on the outer surface of rear end 17 to fixedly engage handle 20 with rear end 17.

Figure 2:
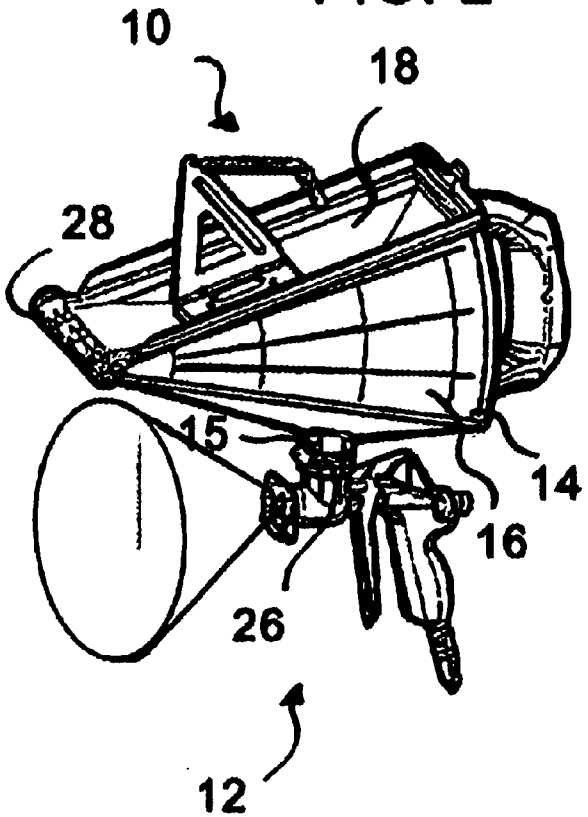
FIG. 2 is an isometric view of the hopper similar to FIG. 1 with the mud gun and hopper fully assembled.
Figures 3, 4:
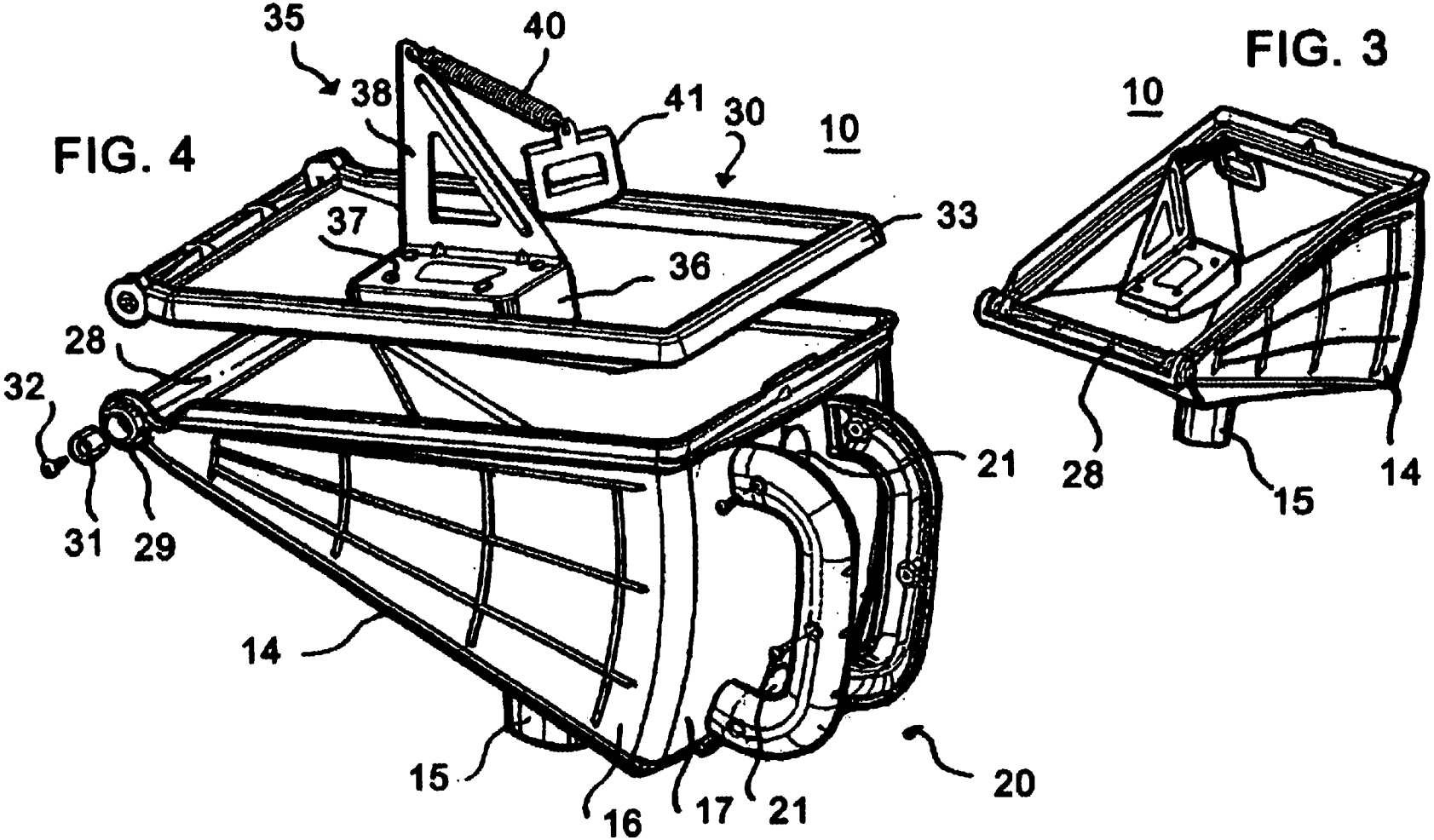
FIG. 3 is an isometric view of the hopper illustrated in FIG. 1, showing various components in better detail.
FIG. 4 is an enlarged, partially exploded isometric view of the hopper illustrated in FIG. 1, showing various components in more detail.

Referring additionally to FIG. 2, it can be seen that outlet orifice 15 of hopper 10 can be conveniently engaged over an inlet orifice 25 of mud gun 12 and held firmly in place by means of a clamp 26 or the like. In this preferred embodiment, wedge shaped box 14 of hopper 10 is constructed so that sides 16 and 18 taper gradually into the bottom surface so as to define a front edge 28, best seen in FIGS. 1 and 3. Sides 16 and 18 are further formed to define cover mounting openings 29 at opposite ends of front edge 28. A generally rectangularly shaped cover 30, which is best seen in FIG. 4, is designed to fit within wedge shaped box 14 of hopper 10 so as to force mud contained in box 14 out through outlet orifice 15.

A front edge of cover 30 is designed to be pivotally mounted adjacent front edge 28 of box 14 between openings 29. The pivotal mounting of cover 30 is accomplished by inserting hinge bearings 31 into openings 29 on opposite sides of front edge 28. Hinge bearings 31 are generally cup-shaped with an opening through the bottom. With the front edge of cover 30 properly positioned between openings 29, screws 32 are inserted through hinge bearings 31 and threadedly engaged into the sides of the front edge of cover 30. Hinge bearings 31 are thereby fixedly attached to opposite sides of the front edge of cover 30 and are rotatably mounted in openings 29 to pivotally fix cover 30 relative to box 14. Cover 30 has an open position for filling box 14 with mud and a closed position substantially covering the upper opening of box 14 in a use or operational position. A rubber seal 33 is affixed over the side and rear edges of cover 30 to ensure that mud contained in box 14 does not exit around cover 30 during operation.

A spring mast 35 is attached to the upper surface of cover 30 by means of a mounting block 36. Mast 35 is constructed with a mounting foot 37 and a perpendicular portion 38. Mounting foot 37 is affixed to the upper surface of mounting block 36 so that perpendicular portion 38 extends upwardly from the upper surface of cover 30. Also, mounting block 36 is tapered slightly, as best seen in FIGS. 1 and 3, so that the upper end of mast 35 is directed slightly toward the front of box 14. A spring 40 has one end engaged in a hole in the upper end of mast 35 with a spring clip 41 affixed to the other end. A catch 42 protrudes outwardly and rearwardly from the upper edge of rear end 17 of box 14. With box 14 full of mud, spring 40 is stretched until spring clip 41 can be engaged over catch 42. In this position, mast 35 and mounting block 36 are designed so that pressure is applied to cover 30 by spring 40, tending to force mud out of box 14 and through outlet orifice 15. Rubber seal 33 is provided to ensure that the mud is forced through orifice 15 and cannot ooze around cover 30.

Figure 5:
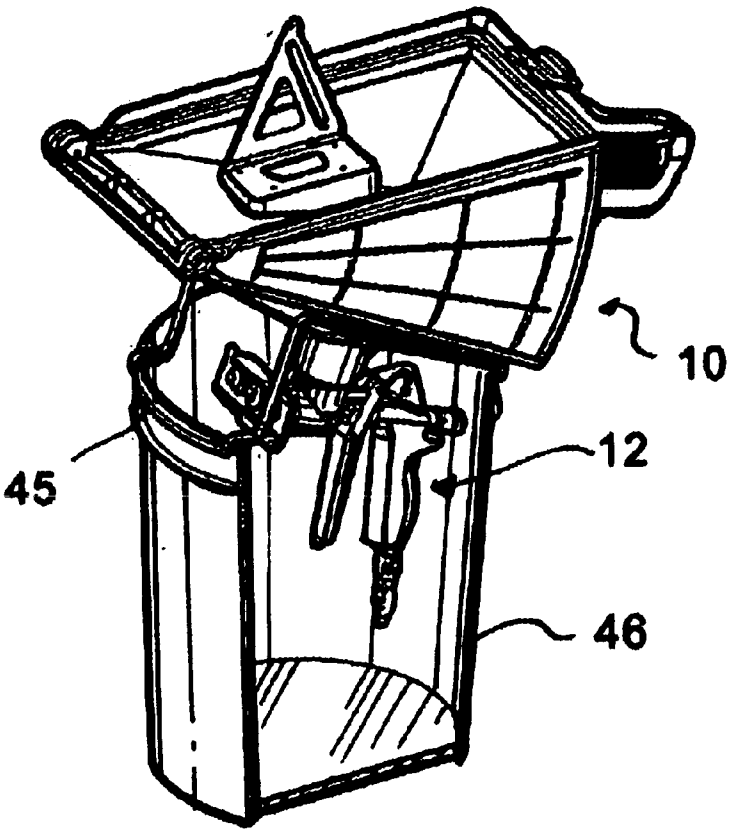
FIG. 5 is an isometric view illustrating the assembled gun and hopper in combination with hopper filling apparatus.
Figure 6:
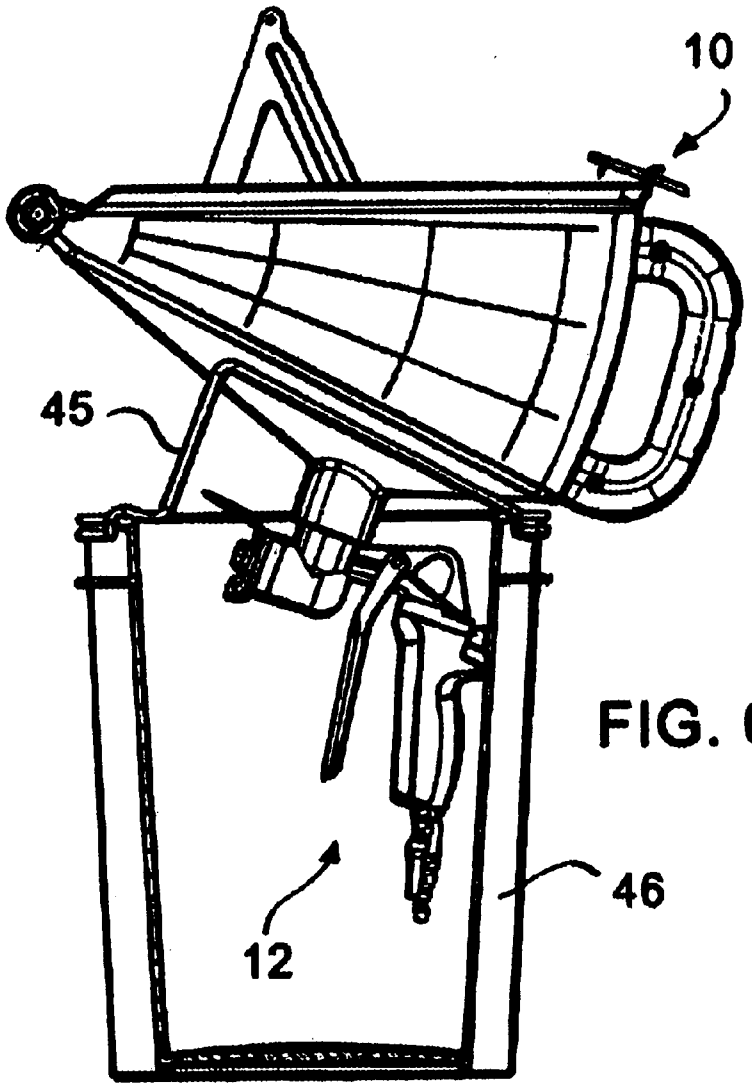
FIG. 6 is an enlarged view in side elevation of the assembled gun and hopper in combination with hopper filling apparatus.

Turning to FIGS. 5 and 6, a wire refill stand 45 is designed to be engaged over the upper edge of a bucket 46 to provide a convenient stand for refilling hopper 10 with mud. Refill stand 45 is constructed so that hopper 10 is cradled therein with mud gun 12 still in the attached position. As can be seen, mud gun 12 is positioned below hopper 10 in bucket 46, with or without an air hose attached, so that hopper 10 can be conveniently filled without the need to remove or detach gun 12. Further, hopper 10 is positioned with the upper opening generally horizontal for maximum filling convenience. The filling operation is performed by simply disengaging spring clip 41 from catch 42 and pivoting cover 30 into the open position. Once hopper 10 is properly filled, spring 40 is stretched until spring clip 41 can be engaged over catch 42 and the hopper and gun assembly is again ready for use.

Figure 8:
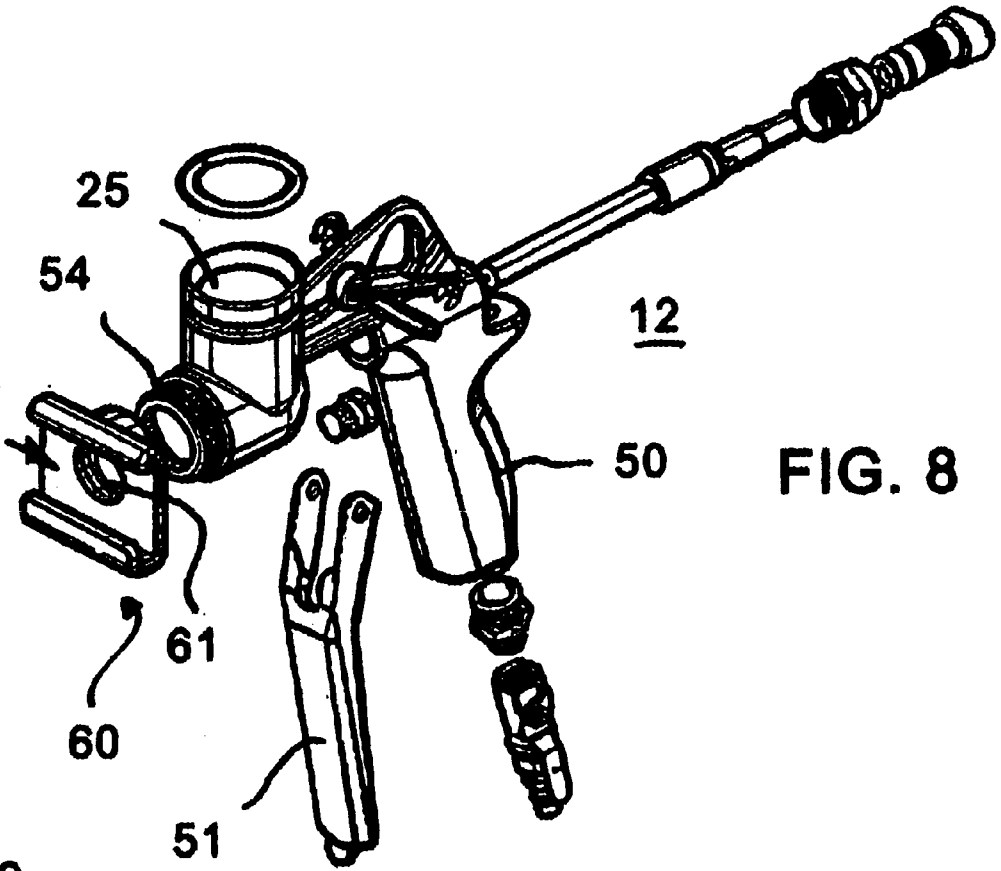
FIG. 8 is an exploded isometric front view of the mud gun of FIG. 1 with the hopper detached.
Figure 7:
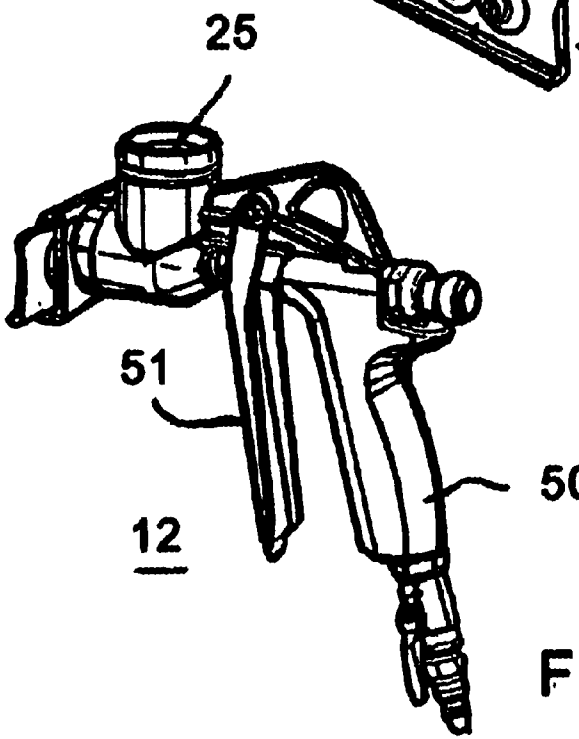
FIG. 7 is an isometric rear view of the mud gun of FIG. 1 with the hopper detached.
Figure 15:
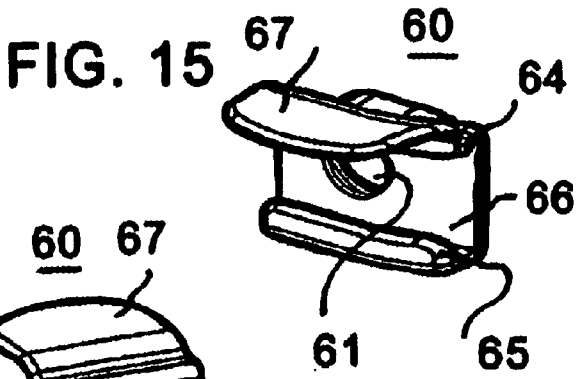
FIG. 15 is a rear isometric view of the nozzle chassis of FIG. 9.
Figure 14:
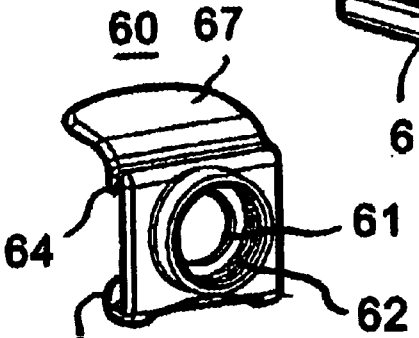
FIG. 14 is a front isometric view of the nozzle chassis of FIG. 9.
Figure 11:
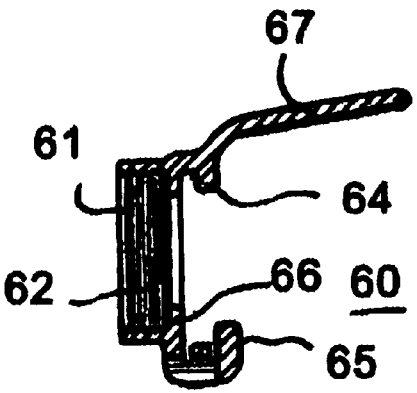
FIG. 11 is a sectional view of the nozzle chassis of FIG. 9 as seen from the line 11—11.
Figure 13:
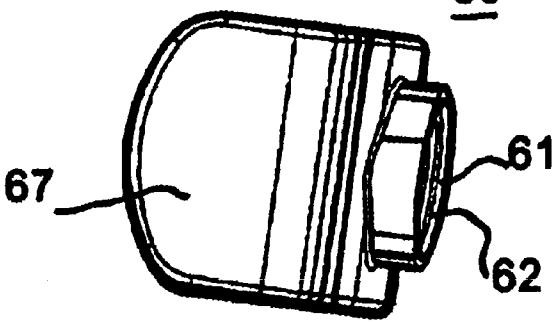
FIG. 13 is a view of the nozzle chassis as seen from the line 13—13 in FIG. 12.
Figure 12:
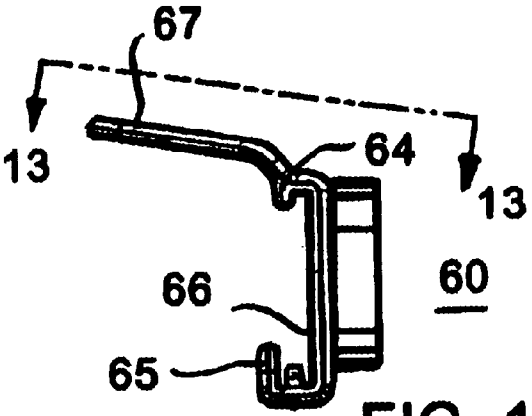
FIG. 12 is an end view of the nozzle chassis as seen from the right side of FIG. 9.
Figure 10:
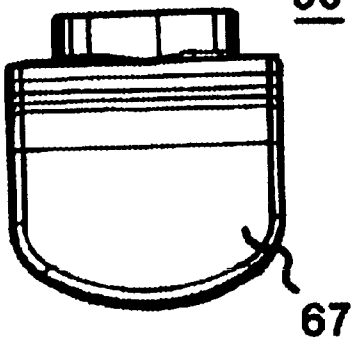
FIG. 10 is a view in top plan of the nozzle chassis of FIG. 9.
Figure 9:
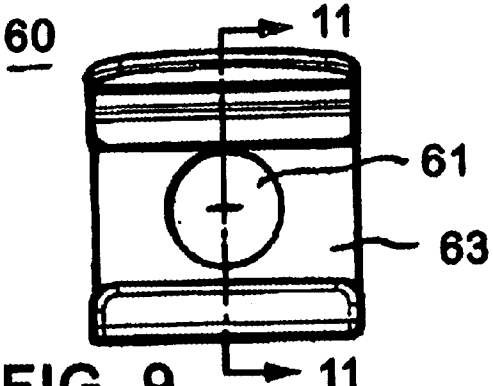
FIG. 9 is a front view of a nozzle chassis for the mud gun of FIG. 1.
Figure 19:
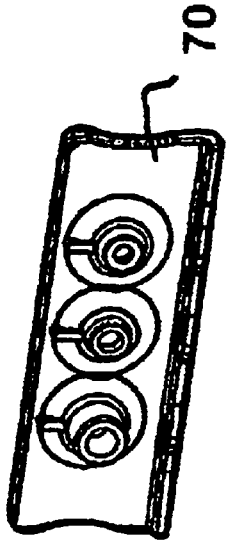
FIG. 19 is a front isometric view of the nozzle bar of FIG. 16.
Figure 20:
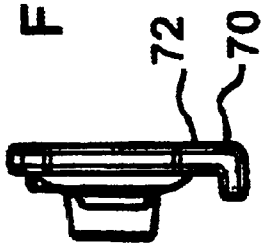
FIG. 20 is an end view of the nozzle bar of FIG. 16, as seen from the right end in FIG. 19.
Figure 21:
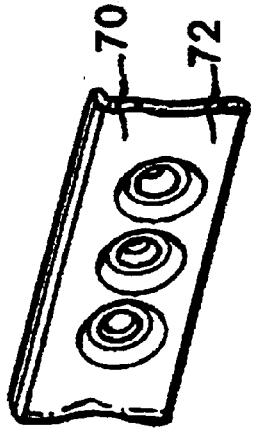
FIG. 21 is a rear isometric view of the nozzle bar of FIG. 16.
Figure 16:
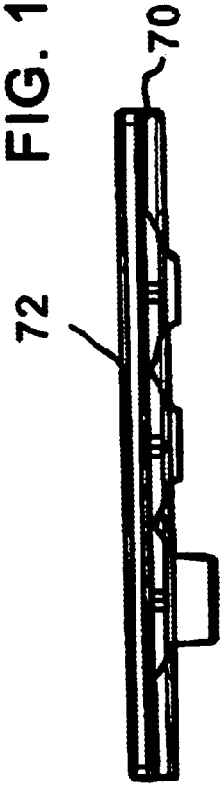
FIG. 16 is a view in top plan of a nozzle bar for use with the nozzle chassis.
Figure 17:
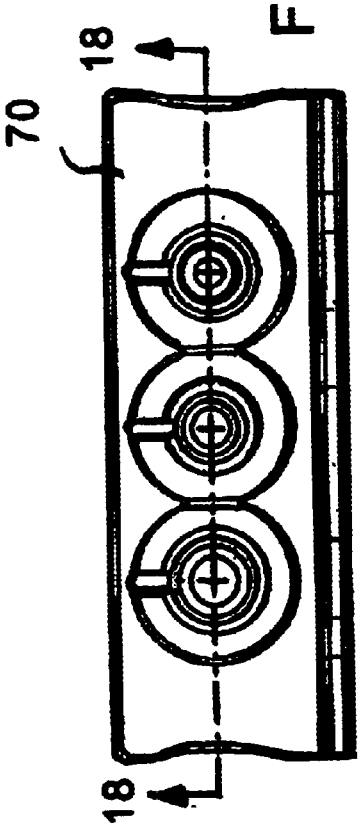
FIG. 17 is a front plan view of the nozzle bar of FIG. 16.
Figure 18:
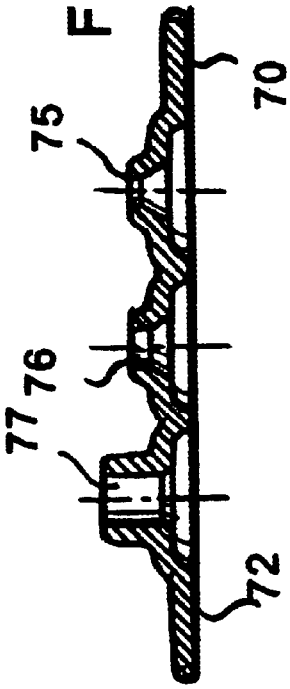
FIG. 18 is a sectional view of the nozzle bar as seen from the line 18—18 in FIG. 17.

Turning now to FIGS. 7 and 8, mud gun 12 is illustrated in an assembled and an exploded view, respectively. Mud gun 12 is a standard commercially available air pressure operated mud gun with a pistol grip type of handle 50 and a pivotally attached trigger 51. Air under pressure is introduced into mud gun 12 at the lower end of handle 50 and mud enters through inlet orifice 25. As previously explained, outlet orifice 15 of hopper 10 is engaged over inlet orifice 25 to provide a steady flow of mud, to mud gun 12. Each time trigger 51 is depressed, air is allowed to enter mud gun 12 and force mud from inlet orifice 25 through an outlet orifice 52 in the front of mud gun 12.

In this embodiment, outlet orifice 52 of mud gun 12 has threads 54 formed around the outer perimeter, as best seen in FIG. 8. A nozzle chassis 60 is formed with a mud inlet opening 61 having threads 62 formed in the inner periphery. Nozzle chassis 60 is mounted on mud gun 12 by simply engaging threads 62 over threads 54 of mud gun 12. Nozzle chassis 60 can best be seen by referring to FIGS. 9 through 15.

Nozzle chassis 60 includes a flat base portion 63 with inlet opening 61 positioned approximately centrally therethrough. The upper and lower edges 64 and 65, respectively; of portion 63 are each turned to form opposed U-shaped portions of a track. Base portion 63 has a flat bearing surface 66 positioned adjacent the track and between upper and lower edges 64 and 65. A splatter hood 67 is optionally provided as an integral portion (or a removable portion if desired) of nozzle chassis 60. Splatter hood 67 is positioned in overlying relationship to nozzles (to be described presently) mounted by nozzle chassis 60. Here it will be understood that nozzle chassis 60 can be formed as a single integral piece, with or without splatter hood 67, or it can be fabricated using a variety of components. The single integral piece is preferred because of its lightness and strength.

Referring additionally to FIGS. 16 through 21, a nozzle bar 70 is illustrated. Nozzle bar 70 is designed specifically for use with nozzle chassis 60 and includes an elongated base portion 71. Base portion 71 has a bearing surface 72 designed to but against bearing surface 66 of nozzle chassis 60. The upper and lower edges of base portion 71 are designed to be engaged in upper and lower U-shaped edges 64 and 65 of nozzle chassis 60 so as to hold bearing surface 72 of nozzle bar 70 tightly against bearing surface 66 of nozzle chassis 60. Three nozzles are formed in nozzle bar 70 with different nozzle orifice sizes, designated 75, 76, and 77. The three nozzles are spaced apart along nozzle bar 70 so that only one nozzle is aligned with inlet opening 61 in nozzle chassis 60 at any time. Each nozzle includes an inlet opening in bearing surface 72 that has a diameter approximately equal to the diameter of inlet opening 61. The inlet opening is then tapered to nozzle orifices 75, 76, and 77. Because bearing surface 72 of nozzle bar 70 is held tightly against bearing surface 66 of nozzle chassis 60, mud cannot escape between the two and must exit only through one of orifices 75, 76, or 77. While three nozzles are illustrated for convenience it will be understood that more or less nozzles can be conveniently incorporated.

Thus, a new and improved mud hopper is disclosed which is constructed to be easily filled without the need to disengage the mud gun. Further, the hopper includes a spring loaded cover that provides a force on mud contained in the hopper to provide a smooth even flow and to ensure complete evacuation of the hopper so that it does not need to be filled as often. Also, a new and improved mud gun has been disclosed which has a plurality of different nozzles conveniently attached. The nozzles can be readily exchanged without the need to empty the mud gun.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A mud application assembly comprising:

a mud hopper having an outlet orifice attachable to a mud gun and through which mud will flow into an attached mud gun;

a cover attached to the mud hopper and rotatable between an open position for filling the hopper with mud and a closed position substantially covering a mud-receiving opening of the hopper during operation; and a releasable biasing structure coupled to the hopper for applying a bias to force mud contained in the hopper toward the outlet orifice.

2. A mud application assembly as claimed in claim 1 wherein the mud hopper includes a generally wedge-shaped box with a bottom wall having an outlet orifice attachable to a mud gun and through which mud will flow into an attached mud gun, the bottom wall defining an edge of the wedge-shaped mud box along one end.

3. A mud application assembly as claimed in claim 2 wherein the mud hopper further includes a generally rectangularly shaped cover rotatably attached to the wedge-shaped mud box along the edge.

4. A mud application assembly as claimed in claim 3 wherein the releasable biasing structure is coupled to the mud box and the cover for biasing the cover toward the bottom wall of the box so as to force mud contained in the box toward the outlet orifice.

5. A mud application assembly as claimed in claim 4 wherein the mud-receiving opening of the box is generally rectangularly shaped and the generally rectangularly shaped cover is formed and mounted to rotate about the edge of the wedge-shaped mud box into the mud-receiving opening of the box and into a substantially parallel abutting position adjacent the bottom wall.

6. A mud application assembly as claimed in claim 5 and further including a sealing mechanism affixed to the cover so that mud contained in the box does not exit around the cover during operation.

7. A mud application assembly as claimed in claim 6 wherein the sealing mechanism includes a resilient seal affixed over edges of the cover.

8. A mud application assembly as claimed in claim 4 wherein the releasable biasing structure includes a mast attached to the cover and a spring attached between the mast and the box.

9. A mud application assembly as claimed in claim 8 wherein the spring of the releasable biasing structure includes a spring clip and the box has a catch attached thereto for releasable engagement of the spring clip and catch.

10. A mud application assembly as claimed in claim 4 wherein the generally wedge-shaped mud box in cludes an upwardly extending end wall affixed to the bottom wall opposite the edge and further includes a handle affixed to an outer surface of the end wall.

11. A mud application assembly as claimed in claim 4 and further including a wire refill stand designed to be engaged over the upper edge of a bucket and for receiving the wedge-shaped mud box to provide a convenient stand for refilling the wedge-shaped mud box with mud.

12. A mud application assembly as claimed in claim 4 further including a mud gun removably attached to the mud box, the mud gun having an inlet orifice releasably attached at to the outlet orifice of the wedge-shaped mud box for receiving mud therethrough.

13. A mud application assembly as claimed in claim 12 wherein the mud gun includes an outlet orifice and a nozzle chassis affixed to the mud gun with a plurality of nozzles movably attached thereto, each nozzle of the plurality of nozzles being movable between a stored position and an aligned position and so that only one nozzle of the plurality of nozzles is aligned with the outlet orifice at a time.

14. A mud application assembly as claimed in claim 13 wherein the nozzle chassis includes an inlet opening positioned relative to the mud gun so that the inlet opening of the nozzle chassis is aligned with the outlet orifice of the mud gun.

15. A mud application assembly as claimed in claim 14 wherein the nozzle chassis defines an elongated track and the plurality of nozzles are mounted in spaced apart relationship on a bar slideably affixed to the track and each nozzle of the plurality of nozzles is movable into alignment with the inlet opening of the nozzle chassis.

16. A mud application assembly as claimed in claim 13 wherein the nozzle chassis further includes a splatter hood positioned in overlying relationship to at least the one of the plurality of nozzles aligned with the outlet orifice of the mud gun.

17. A mud application assembly comprising:

a mud gun including a hollow body with a mud inlet orifice and a mud outlet orifice, the body further including a pressurized air inlet constructed to have a source of pressurized air attached so that when air under pressure is introduced into the air inlet of the mud gun, mud entering through the inlet orifice is forced out through the outlet orifice; and a nozzle chassis affixed to the mud gun with a plurality of nozzles movably attached thereto, each nozzle of the plurality of nozzles being movable between a stored position and a position aligned with the outlet orifice of the mud gun so that only one nozzle of the plurality of nozzles is aligned with the outlet orifice at a time.

18. A mud application assembly as claimed in claim 17 wherein the nozzle chassis includes an inlet opening positioned relative to the mud gun so that the inlet opening of the nozzle chassis is aligned with the outlet orifice of the mud gun.

19. A mud application assembly as claimed in claim 18 wherein the nozzle chassis defines an elongated track and the plurality of nozzles are mounted in spaced apart relationship on a bar slideably affixed to the track and each nozzle of the plurality of nozzles is movable into alignment with the inlet opening of the nozzle chassis.

20. A mud application assembly as claimed in claim 17 wherein the nozzle chassis further includes a splatter hood positioned in overlying relationship to at least the one of the plurality of nozzles aligned with the outlet orifice of the mud gun.

21. A mud application assembly as claimed in claim 17 further including a mud hopper removably attached to the mud gun, the mud hopper having an outlet orifice releasably attached to the inlet orifice of the mud gun for providing mud therethrough.

22. A mud application assembly as claimed in claim 17 wherein the mud hopper includes a cover attached to the mud hopper and rotatable between an open position for filling the mud hopper with mud and a closed position substantially covering a mud-receiving opening of the mud hopper during operation, and a releasable biasing structure coupled to the mud hopper for supplying a bias to force mud contained in the mud hopper toward the outlet orifice.

23. A mud application assembly as claimed in claim 17 wherein the mud hopper includes a generally wedge-shaped mud box with a bottom wall having an outlet orifice attachable to the mud gun and through which mud will flow into the attached mud gun, the bottom wall defining an edge of the wedge-shaped mud box along one end, a generally rectangularly shaped cover rotatably attached to the wedge-shaped mud box along the edge, the cover being rotatable between an open position for filling the box with mud and a closed position substantially covering a mud-receiving opening of the box during operation, and a releasable biasing structure coupled to the box and the cover for biasing the cover toward the bottom wall of the box so as to force mud contained in the box toward the outlet orifice.

24. A mud application assembly comprising:

a mud hopper including a generally wedge-shaped mud box with a bottom wall having a mud outlet orifice attachable to a mud gun and through which joint compound or the like will flow into an attached mud gun, the bottom wall defining an edge of the wedge-shaped mud box along one end, a generally rectangularly shaped cover rotatably attached to the wedge-shaped mud box along the edge, the cover being rotatable between an open position for filling the box with mud and a closed position substantially covering a mud-receiving opening of the box during operation, and a releasable biasing structure coupled to the box and the cover for biasing the cover toward the bottom wall of the box so as to force mud contained in the box toward the mud outlet orifice; and a mud gun including a hollow body with a mud inlet orifice and a mud outlet orifice, the mud outlet orifice of the hopper being releasable attached to the mud inlet orifice of the mud gun, the body further including a pressurized air inlet constructed to have a source of pressurized air attached so that when air under pressure is introduced into the air inlet of the mud gun, mud entering through the mud inlet orifice of the gun is forced out through the mud outlet orifice of the gun, and a nozzle chassis affixed to the mud gun with a plurality of nozzles movably attached thereto, each nozzle of the plurality of nozzles being movable between a stored position and a position aligned with the mud outlet orifice of the mud gun so that only one nozzle of the plurality of nozzles is aligned with the mud outlet orifice of the gun at a time.

25. A mud application assembly as claimed in claim 17 wherein the mud gun further includes a trigger assembly affixed to the body with a valve positioned between the air inlet of the mud gun and the outlet orifice of the mud gun for introducing pressurized air from the air inlet into the hollow body so that mud entering through the inlet orifice is forced out through the outlet orifice.

* * * * *